US007360337B2

(12) United States Patent
Yoneyama

(10) Patent No.: US 7,360,337 B2
(45) Date of Patent: Apr. 22, 2008

(54) DOOR CLOSING APPARATUS

(75) Inventor: Fumihiro Yoneyama, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 491 days.

(21) Appl. No.: 10/982,780

(22) Filed: Nov. 8, 2004

(65) Prior Publication Data

US 2005/0167991 A1 Aug. 4, 2005

(30) Foreign Application Priority Data

Nov. 7, 2003 (JP) ..... 2003-378779

(51) Int. Cl.
*E05F 11/02* (2006.01)

(52) U.S. Cl. ..... 49/281; 49/280; 49/360

(58) Field of Classification Search ..... 49/279, 49/280, 281, 360; 296/155; 292/199, 201, 292/216, 336.2
See application file for complete search history.

(56) References Cited

U.S. PATENT DOCUMENTS 6,131,337 A * 10/2000 Machida ..... 49/280
6,607,222 B2 * 8/2003 Inoue ..... 292/216
6,863,336 B2 * 3/2005 Yokomori et al. ..... 296/155
6,974,165 B2 * 12/2005 Koike et al. ..... 292/216
7,003,915 B2 * 2/2006 Yokomori ..... 49/360
7,243,960 B2 * 7/2007 Hoshikawa et al. ..... 292/216
2001/0005080 A1 * 6/2001 Inoue ..... 292/216
2005/0087994 A1 * 4/2005 Umino ..... 292/216

FOREIGN PATENT DOCUMENTS

| | | | |
|---|---|---|---|
| JP | 9-49356 | A | 2/1997 |
| JP | 9-60371 | A | 3/1997 |
| JP | 2658272 | B2 | 6/1997 |
| JP | 2803122 | B2 | 7/1998 |
| JP | 10-266668 | A | 10/1998 |
| JP | 3141548 | B2 | 12/2000 |

* cited by examiner

*Primary Examiner*—Jerry Redman
(74) *Attorney, Agent, or Firm*—Sughrue Mion, PLLC

(57) ABSTRACT

A door closing apparatus has a latch mechanism that holds a door in a half-closed state and a fully-closed state to a vehicle body. An actuator drives the door when the door is in the half-closed state, a sector gear rotates as the actuator is driven. A first close lever performs closing action according to rotation of the sector gear, and a second close lever performs a door closing action according to the closing action to cause the latch mechanism to perform the closing action. A cancel lever is swingably disposed to the first close lever via a first spring. The cancel lever comes in engagement with the sector gear in a normal state, while performing a door opening action against the biasing force of the first spring to cancel the engagement with the sector gear when an opening operation of an operation handle is performed.

6 Claims, 8 Drawing Sheets

DOOR CLOSING APPARATUS

BACKGROUND OF THE INVENTION

1) Field of the Invention

The present invention relates to a door closing apparatus that is applied to vehicles.

2) Description of the Related Art

Conventionally, in a vehicle, for example, a four-wheel automobile, when a door such as a slide door is in a half-closed state (a non-complete closed state) towards a vehicle body, a door closing apparatus for bringing the door to a fully-closed state (a completely-closed state) has been known.

As one example of such the door closing apparatus, there is an apparatus provided with a latch mechanism that is arranged in the door to hold the door in a half-closed state and a fully-closed state to a vehicle body, and an actuator that is driven when the door is in the half-closed state. A first actuation lever (active lever) interlocked with the actuator performs a closing action according to drive of the actuator and a second actuation lever (passive lever) engaged with the first actuation lever via an engaging pin performs a door closing action. As a result, the latch mechanism interlocked with the second actuation lever performs a closing action from a half-latched state to a fully-latched state to bring the door to the fully-closed state to the vehicle body. When the door closing apparatus brings the door from the half-closed state to the fully-closed state, a user performs an opening operation of an inside handle or an outside handle (an operation handle) to cause a releasing lever (a cancel lever) interlocked with the operation handle and arranged swingably to perform a door opening action, so that the engaging pin is moved in a sliding manner to disengage the first actuation lever and the second actuation lever from each other, thereby disabling drive of the actuator (Patent Literature 1: Japanese Patent Publication No. 2803122).

As another example of the door closing apparatus, there is an apparatus for which the cancel lever is arranged swingably to the second actuation lever, and the first actuation lever and the second actuation lever are engaged with each other in a sandwiching manner of the cancel lever between the first actuation lever and the second actuation lever, where, when the door is brought from the half-closed state to the fully-closed state, the cancel lever performs a door opening action to disengage the first actuation lever and the second actuation lever from each other and disable drive of the actuator according to an opening operation of the inside handle or the outside handle performed by a user (Patent Literature 2: Japanese Patent Publication No. 3141548).

In the door closing apparatus proposed in the Patent Literature 1, since the first actuation lever and the second actuation lever are engaged with each other via the engaging pin, more specifically, both are engaged with each other via an engaging pin received in an elongated hole formed in the first actuation lever and a deformed hole formed in the second actuation lever. This causes a relatively large mechanical load being imparted on the engaging pin in the closing action of the first actuation lever and the door closing action of the second actuation lever according to drive of the actuator. Therefore, it becomes difficult to cause the cancel lever to perform the door opening action to move the engaging pin smoothly in a sliding manner according to an opening operation of the inside handle or the outside handle conducted by a user. Consequently, disabling of drive of the actuator may not be performed smoothly.

In the door closing apparatus proposed in the Patent Literature 2, since the first actuation lever and the second actuator lever are engaged with each other in a sandwiching manner of the cancel lever between the first actuation lever and the second actuation lever, when the cancel lever is caused to perform a door opening action according to an opening operation of the inside handle or the outside handle conducted by the user, the first actuation lever is slid, so that it becomes difficult to disengage the first actuation lever and the second actuation lever from each other smoothly. As a result, disabling of drive of the actuation may not be performed smoothly. Particularly, in the door closing apparatus, since the first actuation lever moves straightly, a relatively large force against frictional resistance is required for causing the cancel lever to perform the door opening action between the first actuation lever moving straightly and the cancel lever, which results in difficulty in smooth disengagement between the first actuation lever and the second actuation lever.

SUMMARY OF THE INVENTION

It is an objective of the present invention to provide a door closing apparatus that is smooth in operation.

A door closing apparatus according to an aspect of the present invention is used for closing a door. The door closing apparatus includes a latch mechanism that is disposed on one of a vehicle body and a door to hold the door to the vehicle body in a half-closed state and in a fully-closed state; an actuator that is driven when the door is in the half-closed state; a rotary body that is rotated according to drive of the actuator; a first actuation lever that performs a closing action according to rotation of the rotary body; a second actuation lever that performs a door closing action according to the closing action of the first actuation lever to cause the latch mechanism to perform a closing action according to the door closing action, where the door closing apparatus is constituted to bring the half-closed state of the door to the fully-closed state; and a cancel lever that is swingably disposed on the first operation lever via a resilient body, and that is brought in engagement with the rotary body by biasing force of the resilient body in a normal state, while performing a door opening action against the biasing force of the resilient body to cancel engagement with the rotary body, when an operation handle provided on the door is operated for opening.

The other objects, features, and advantages of the present invention are specifically set forth in or will become apparent from the following detailed description of the invention when read in conjunction with the accompanying drawings.

DETAILED DESCRIPTION

Exemplary embodiments of a door closing apparatus according to the present invention will be explained in detail with reference to the accompanying drawings. Note that the invention is not limited thereto.

Figure 1:
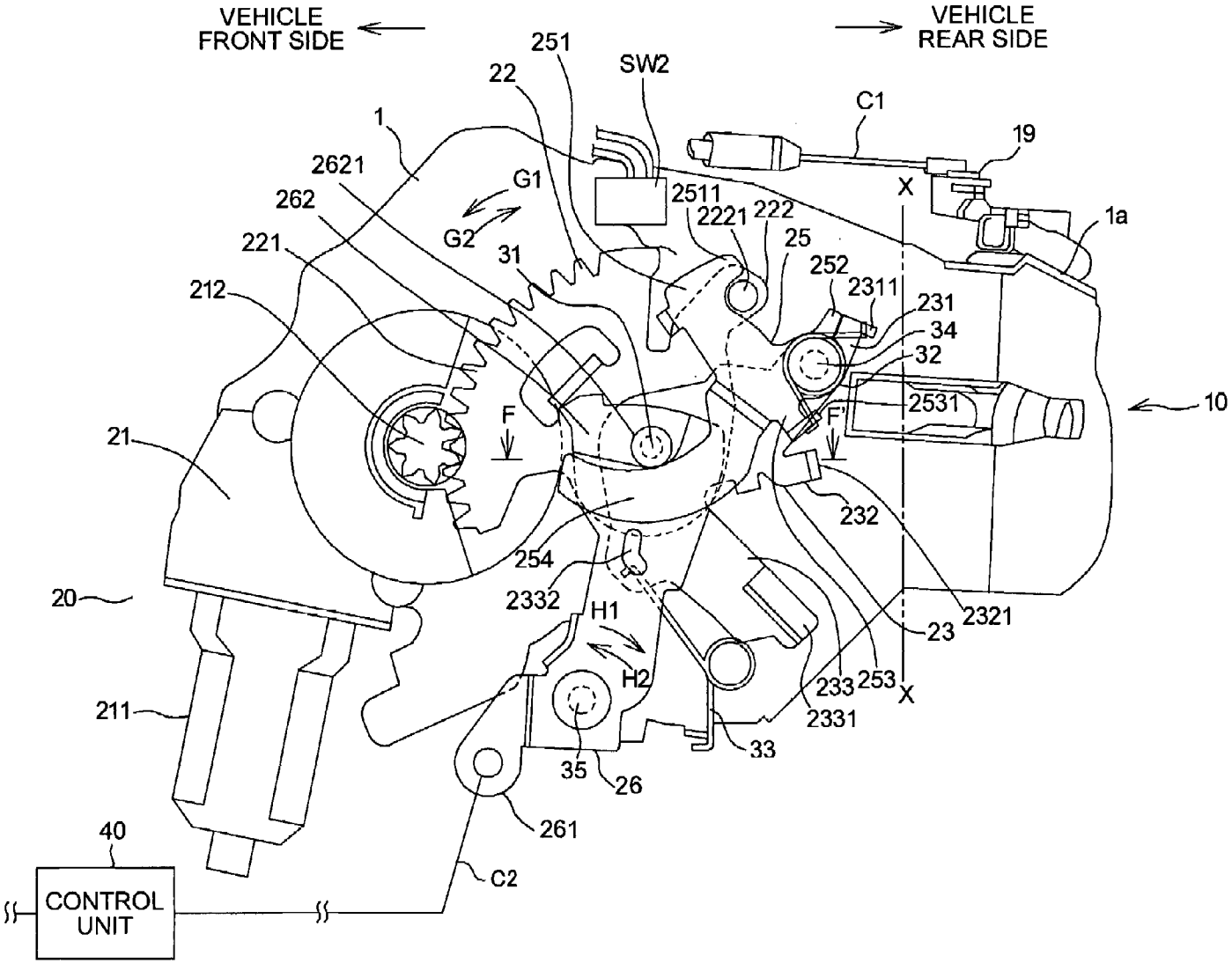
FIG. 1 is a schematic diagram of a main unit of a door closing apparatus as viewed from an opposite side (an outer side) to a vehicle body; according to an embodiment of the present invention.
Figure 2:
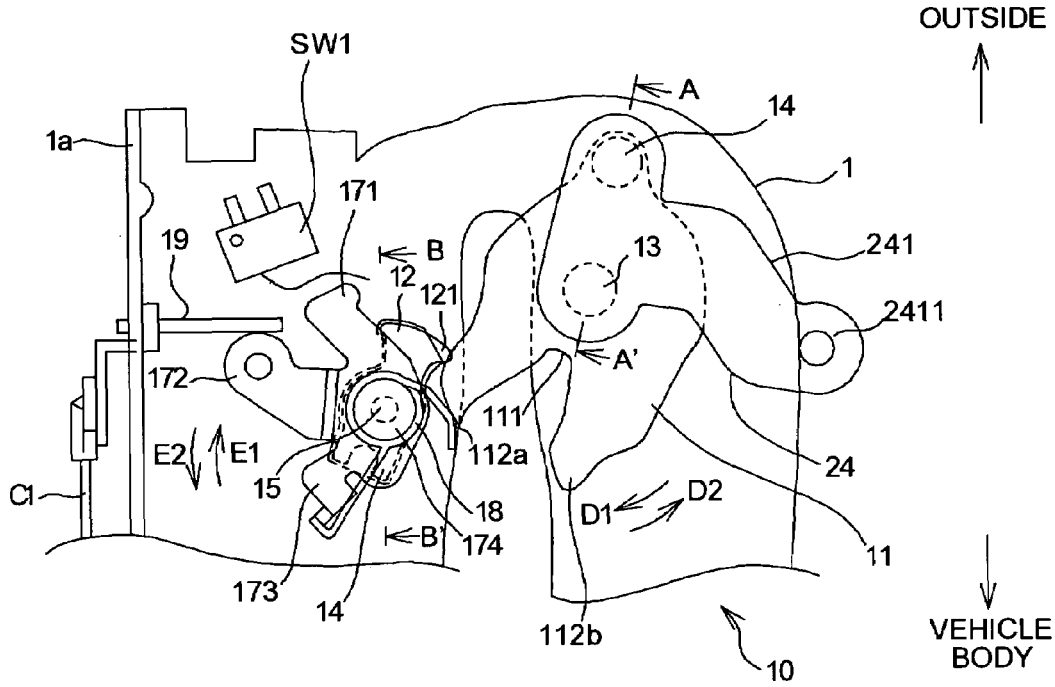
FIG. 2 is a schematic diagram of the door closing apparatus shown in FIG. 1, as viewed from a front side of the vehicle body according to the embodiment of the present invention.

A door closing apparatus according to an embodiment of the present invention will be explained below in such a manner that the door closing apparatus is applied to a slide door arranged openably/closably to a vehicle body, for example, a four-wheel automobile. FIGS. 1 and 2 are diagrams of a main unit of the door closing apparatus according to an embodiment of the present invention. FIG. 1 is an explanatory diagram of the main unit, as viewed from an opposite side (an outer side) to the vehicle body, where a left side on the drawing denotes the vehicle front side, and a right side thereon denotes the vehicle rear side. FIG. 2 is an explanatory diagram of the door closing apparatus shown in FIG. 1, as viewed from the vehicle front side, where an upper side on the drawing denotes an outside and a lower side thereon denotes the vehicle body side. FIGS. 1 and 2 both show only parts of the door related to the door closing apparatus of the present invention.

In FIGS. 1 and 2, the door closing apparatus according to an embodiment of the present invention is provided with a latch mechanism 10 and a door closing mechanism 20, and the latch mechanism 10 and the door closing mechanism 20 are disposed on a common cover plate 1. The cover plate 1 is made of a metal plate, and it is bent such that a bent angle forms an obtuse angle along a double-dotted chain line (X-X') shown in FIG. 1.

Figure 3:
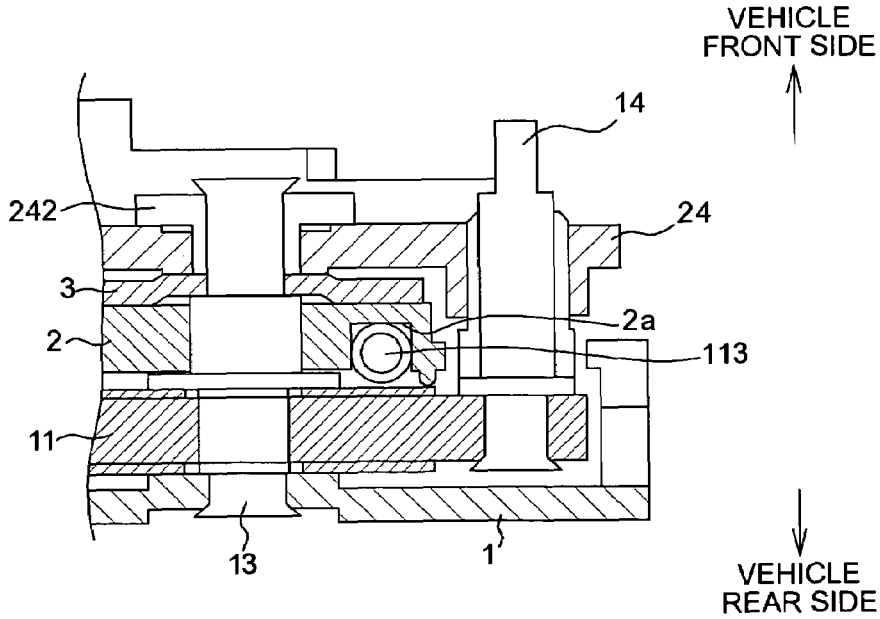
FIG. 3 is a cross-sectional schematic view taken along a line A-A' shown in FIG. 2.

As shown in FIG. 2, the latch mechanism 10 is provided with a latch 11 and a ratchet 12. The latch 11 has a groove 111 and two pawls 112*a*, 112*b*. The latch 11 is supported swingably about an axial center of a latch shaft 13 disposed on the cover plate 1 along an arrow D1 direction and an arrow D2 direction by the latch shaft 13. In further detail, as shown in FIG. 3, the latch 11 is disposed on the cover plate 1 between the cover plate 1 and a case 2, and it is swingably supported to the latch shaft 13 received in the case 2. FIG. 3 is a sectional view taken along a line A-A' on FIG. 2, where an upper side on the drawing denotes the vehicle front side and a lower side thereof denotes the vehicle rear side. Since a pin (not shown) is caused to abut on a latch spring 113 disposed in a groove 2*a* of the case 2, the latch 11 is always biased in the arrow D2 direction by biasing force of the latch spring 113.

Figure 4:
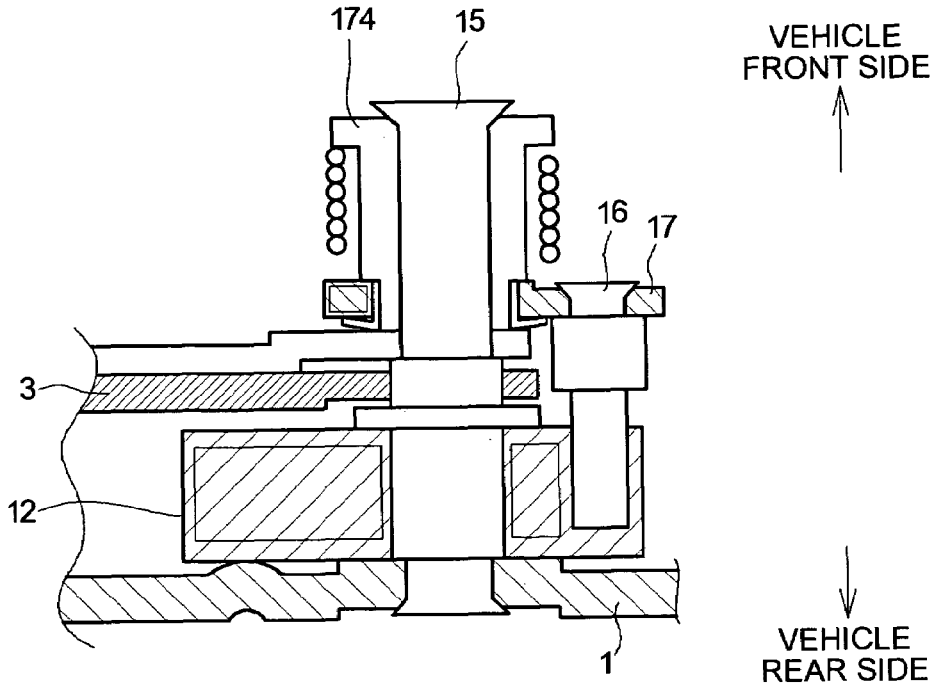
FIG. 4 is a cross-sectional schematic view taken along a line B-B' shown in FIG. 2.

The ratchet 12 has an engaging pawl 121 for engagement with the pawls 112*a*, 112*b* of the latch 11, and it is supported swingably about an axial center of a ratchet shaft 15 disposed on the cover plate 1 along an arrow E1 direction and an arrow E2 direction by the ratchet shaft 15. In further detail, as shown in FIG. 4, the ratchet 12 is disposed on the cover plate 1 between the cover plate 1 and a back plate 3, and it is swingably supported to the ratchet shaft 15 penetrating the back plate 3. FIG. 4 is a sectional view taken along a line B-B' on FIG. 2, where an upper side on the drawing denotes the vehicle front side and a lower side thereof denotes the vehicle rear side. The ratchet 12 is provided to be continuous to a ratchet lever 17 via a ratchet pin 16.

In FIG. 2, the ratchet lever 17 has a tongue-shaped contact piece 171 extending obliquely leftward and upward, a tongue-shaped abutting piece 172 extending leftward, and an engaging piece 173 extending obliquely leftward and downward, and it is supported swingably by the ratchet shaft 15. More specifically, as shown in FIG. 4, the ratchet lever 17 is supported to the ratchet shaft 15 swingably about an axial center of the ratchet shaft 15 via a spacer 174 on the vehicle front side of the back plate 3. In such a constitution that one end of a ratchet spring 18 wound on the ratchet shaft 15 and the spacer 174 is retained at the cover plate 1 and the other end thereof is retained at the engaging piece 173, the ratchet lever 17 is biased in the arrow E1 direction by biasing force of the ratchet spring 18. That is, the ratchet 12 is also biased in the arrow E1 direction by the biasing force of the ratchet spring 18 like the ratchet lever 17.

A ratchet switch SW1 is disposed above the contact piece 171 of the ratchet lever 17. As described later in detail, the ratchet switch SW1 is for detecting whether the slide door is in a half-closed state or in a fully-closed state to the vehicle body (not shown), that is, whether the latch mechanism 10 is in a half-latched state or in a fully-latched state.

An open lever 19 is disposed outside of the abutting piece 172 of the ratchet lever 17 such that it can abut on the abutting piece 172. That is, the open lever 19 is swingably supported so as to be received in a supporting hole (not shown) formed on a bent unit 1*a* of the cover plate 1. The open lever 19 is swung in an interlocking manner with an opening operation of an inside handle or an outside handle arranged on the slide door to abut on the abutting piece 172 of the ratchet lever 17 and swing the ratchet lever 17 in the arrow E2 direction on FIG. 2. Specifically, the open lever 19 is connected to a control unit 40 via a first cable C1, and it is coupled to the inside handle or the outside handle via the control unit 40.

The door closing mechanism 20 is provided with an actuator 21, a sector gear (a rotary body) 22, a first close lever (a first actuation lever) 23, a second close lever (a second actuation lever) 24, and a cancel lever (a releasing lever) 25.

The actuator 21 has a motor 211, a reversible rotating motor shaft (not shown), and a pinion 212 rotated in a clockwise direction and in a counterclockwise direction according to rotation of the motor shaft.

Figure 5:
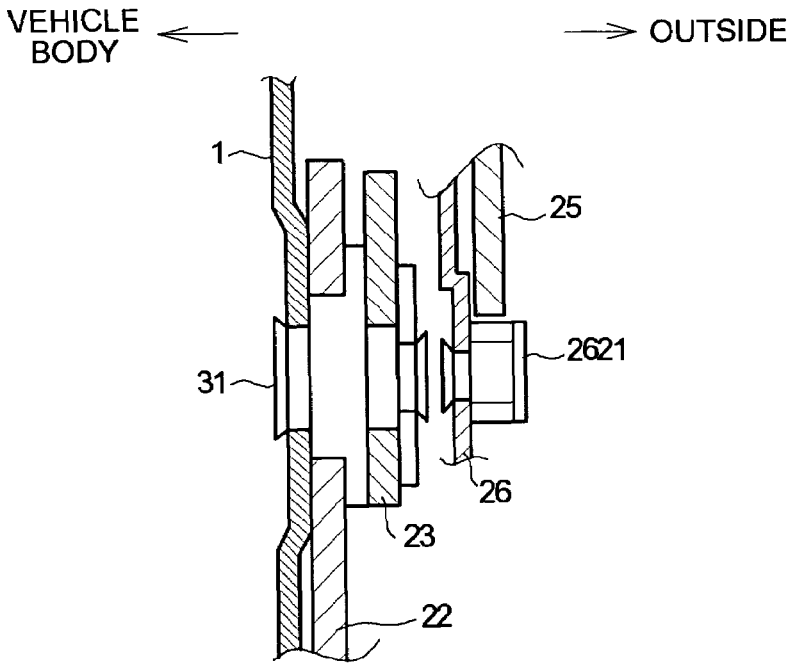
FIG. 5 is a cross-sectional schematic view taken along a line F-F' shown in FIG. 1.

As shown in FIG. 5, the sector gear 22 is rotatably supported about an axial center of a first shaft 31 disposed on the cover plate 1 by the first shaft 31. FIG. 5 is a sectional view taken along a line F-F' on FIG. 1. The sector gear 22 has a meshing unit 221 and an engaging unit 222 extending in a direction different from the meshing unit 221. The meshing unit 221 meshes with the pinion 212 of the actuator 21. Accordingly, the sector gear 22 rotates along an arrow G1 direction and an arrow G2 direction according to rotation of the pinion 212. The engaging unit 222 is formed with an engaging projection 2221 projecting outwardly, and the engaging projection 2221 is for engagement with the cancel lever 25. As shown in FIG. 1, the sector switch SW2 is disposed above the sector gear 22 of the cover plate 1. The sector switch SW2 is for detecting that the sector gear 22 rotates from an initial or home position shown in FIG. 1 along the arrow G1 direction, and thereafter, it returns back to the initial position along the arrow G2 direction again.

The first close lever 23 has an engaging unit 231 extending in an obliquely upward direction toward the vehicle rear side, a restricting unit 232 extending toward the vehicle rear side, and an abutting unit 233 extending in an obliquely downward direction toward the vehicle rear side. As shown in FIG. 5, the first close lever 23 is supported by the first shaft 31 outside of the sector gear 22 swingably about an axial center of the first shaft 31. An engaging piece 2311 is disposed on the engaging unit 231, and the engaging piece 2311 retains one end of a first spring (a resilient body) 32. The restricting unit 232 is formed with a restricting piece 2321 extending outwardly. The abutting unit 233 is formed with the engaging piece 2331 bent outwardly. The abutting unit 233 is also formed with an engaging hole 2332, and the engaging hole 2332 retains a second spring (a resilient member) 33. The first close lever 23 is positioned at the initial position shown in FIG. 1 by biasing force of the second spring 33.

In FIG. 2, the second close lever 24 has a tongue-shaped abutting unit 241 extending rightward, and the abutting unit 241 is provided with an abutting pin 2411 projecting toward the vehicle front side. As shown in FIG. 3, the second close lever 24 is disposed to the latch shaft 13 swingably about an axial center of the latch shaft 13 via a spacer 242 on the vehicle front side ahead of the back plate 3, and it is disposed integrally with the latch 11 via a latch pin 14. That is, the second close lever 24 is swung integrally with the latch 11 along the arrow D1 direction and the arrow D2 direction.

The cancel lever 25 is supported to a second shaft 34 arranged on the first close lever 23 swingably about an axial center of the second shaft 34. As shown in FIG. 1, the cancel lever 25 has an engaging unit 251 extending in an obliquely upward direction toward the vehicle front side, an abutting piece 252 projecting in an obliquely upward direction toward the vehicle rear side, a retaining unit 253 projecting in an obliquely downward direction toward the vehicle rear side, and a bent piece 254 bent entirely and extending in an obliquely downward direction toward the vehicle front side. The engaging unit 251 is formed with a projection-shaped engaging piece 2511. The retaining unit 253 is formed with an engaging piece 2531 retaining the other end of the first spring 32. That is, the cancel lever 25 is engaged with the first close lever 23 in such a manner that the abutting piece 252 has abutted on an engaging piece 2311 of the first close lever 23 from the vehicle body by biasing force of the first spring 32.

On the other hand, a fail-safe lever (a third actuation lever) 26 is arranged to a third shaft 35 arranged on the common cover plate 1 swingably about an axial center of the third shaft 35 between the first close lever 23 and the cancel lever 25. A base 261 of the fail-safe lever 26 is connected with a second cable C2 connected to the control unit 40, and it is swung about the axial center of the third shaft 35 along an arrow H1 direction and an arrow H2 direction in an interlocking manner with an opening operation of an inside handle or an outside handle arranged on the slide door like the open lever 19. An end 262 of the fail-safe lever 26 is provided with a pin 2621 extending outwardly, and the pin 2621 comes in slidable contact with the bent piece 254 of the cancel lever 25.

Figure 6:
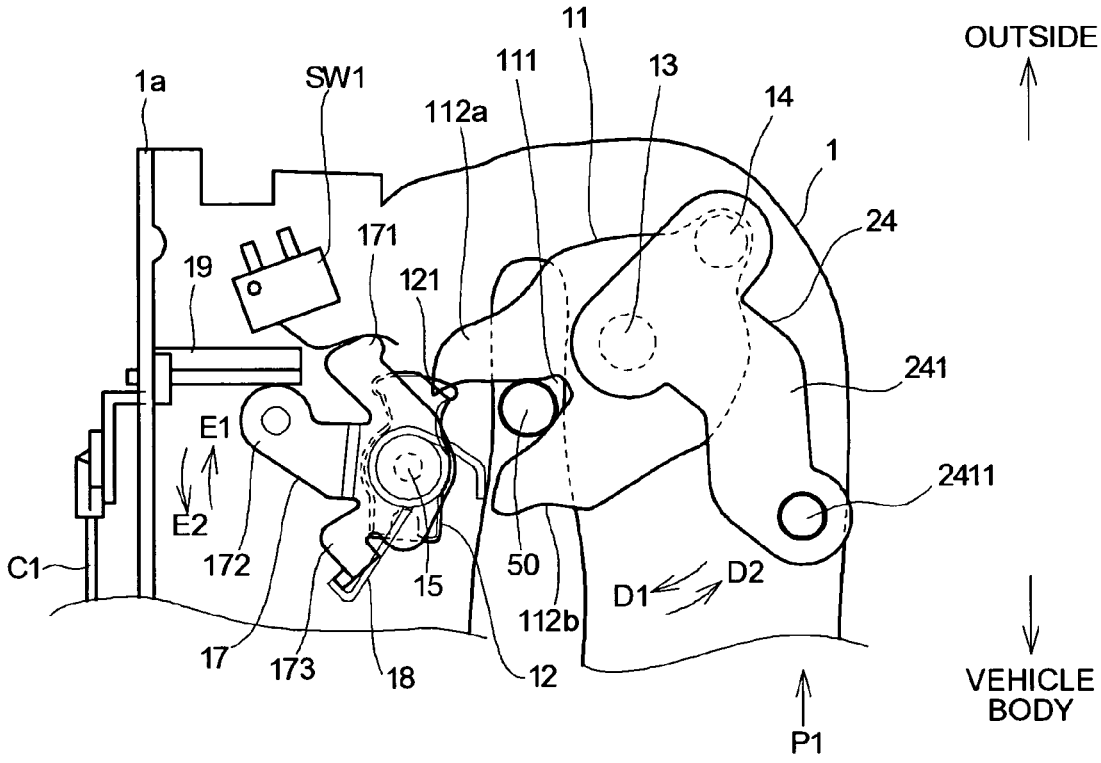
FIG. 6 is a schematic diagram of an action of the door closing apparatus shown in FIG. 2.

The door closing apparatus performs the following actions. When the slide door is moved for opening to the vehicle body, a striker 50 (see FIG. 6) on the vehicle body side relatively advances into the groove 111 of the latch 11 to abut on the latch 11 in the latch mechanism 10, so that the latch 11 is swung along the arrow D1 direction against the biasing force of the latch spring 113. However, a swinging amount of the latch 11 is small due to such a cause that a force required for closing movement of the slide door is weak, so that the latch mechanism 10 is brought into a half-latched state so that the engaging pawl 121 of the ratchet 12 is engaged with the pawl 112*a* of the latch 11, as shown in FIG. 6. When the latch mechanism 10 is in the half-latched state in this manner, the slide door is in a half-closed state to the vehicle body. In this case, the second close lever 24 swung integrally with the latch 11 is also swung along the arrow D1 direction to be positioned at an abutting position P1.

Such a state that the latch mechanism 10 is brought into the half-latched state is detected by abutting of the contact piece 171 of the ratchet lever 17 on the ratchet switch SW1. When the half-latched state is detected by the ratchet switch SW1 in this manner, the motor 211 of the actuator 21 is driven so that the pinion 212 is rotated in a clockwise direction. Thereby, the sector gear 22 meshing with the pinion 212 rotates along the arrow G1 direction. Start of such a rotation of the sector gear 22 is detected by the sector switch SW2.

Figure 7:
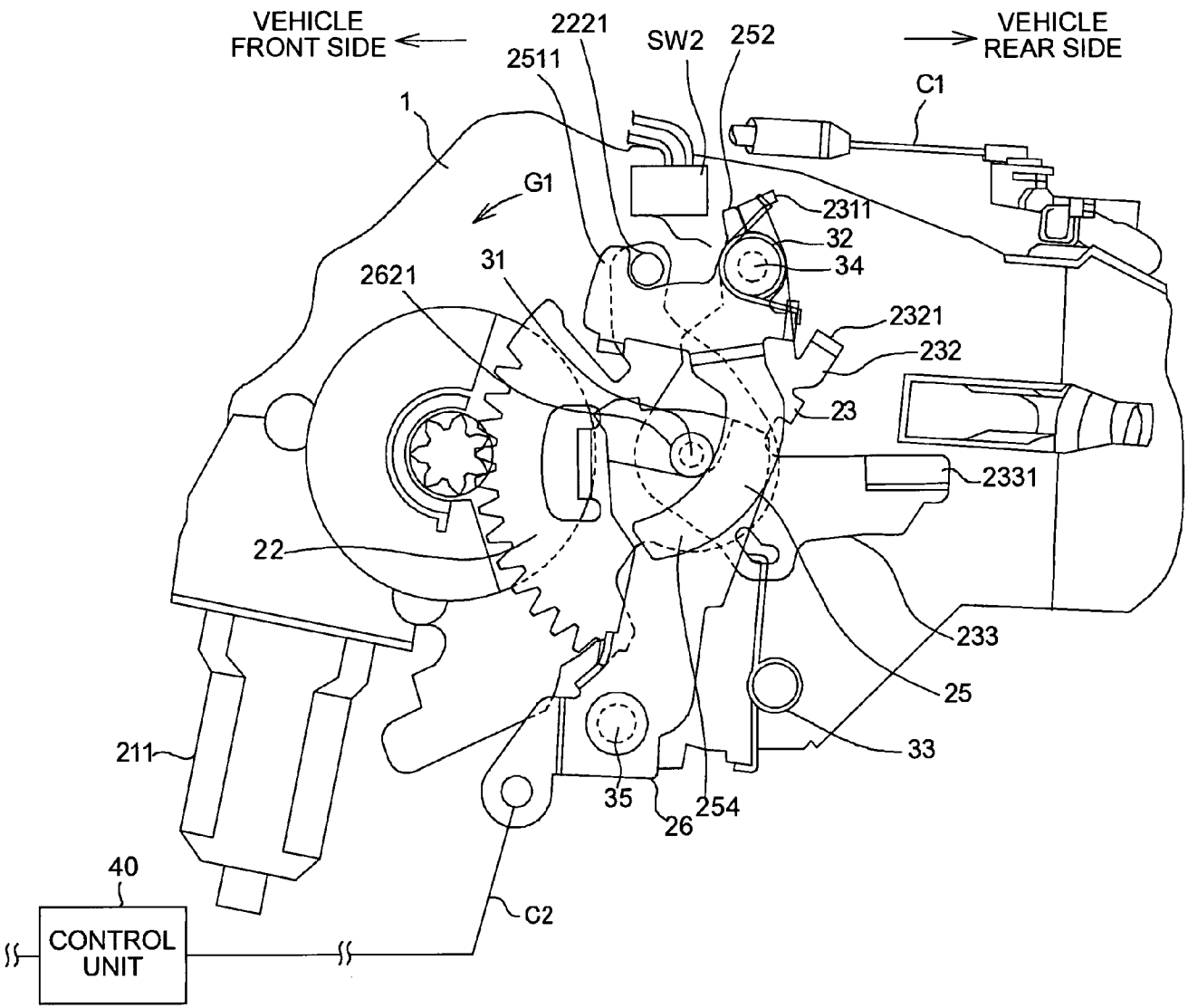
FIG. 7 is a schematic diagram showing more details of the main unit of the door closing apparatus shown in FIG. 1.

As shown in FIG. 7, according to the rotation of the sector gear 22, the cancel lever 25 engaged with the sector gear 22 via the engaging projection 2221 and the first close lever 23 engaged with the cancel lever 25 are swung about the axial center of the first shaft 31 along the arrow G1 direction. In this case, the first close lever 23 is swung against the biasing force of the second spring 33 (performs a closing action).

Figure 8:
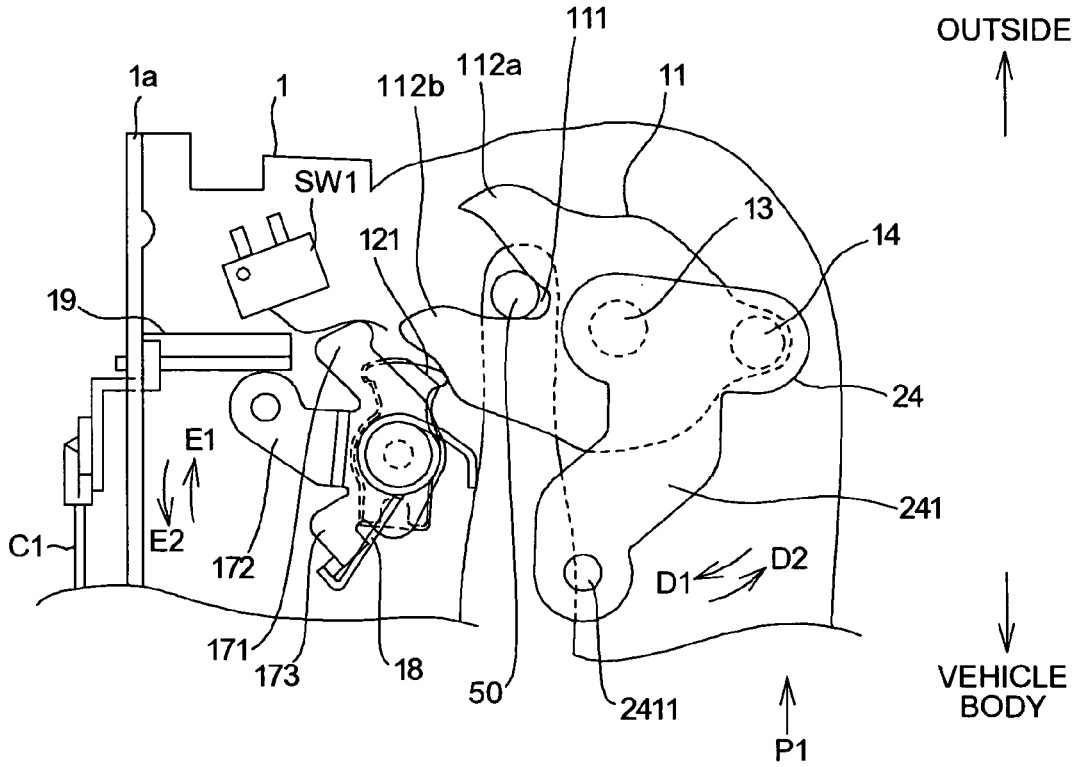
FIG. 8 is a schematic diagram showing more details of the door closing apparatus shown in FIG. 2.

The abutting piece 2331 of the first close lever 23 performing a closing action abuts on the abutting pin 2411 of the second close lever 24 positioned at the abutting position P1 to press the abutting pin 2411 so that the second close lever 24 swings in the arrow D1 direction (performs a door closing action) and the latch 11 swung integrally with the second close lever 24 also swings in the arrow D1 direction. Thereby, the latch mechanism 10 comes into a fully-latched state where the pawl 121 of the ratchet 12 is engaged with the pawl 112*b* of the latch 11, as shown in FIG. 8. As a result, the slide door reaches a fully-closed state to the vehicle body.

Such a state that the latch mechanism 10 has reached the fully-latched state can be detected from an action where the ratchet 12 engaged with the latch 11 and the ratchet lever 17 are swung along the arrow E2 direction according to swinging of the latch 11 so that the contact piece 171 of the ratchet lever 17 abuts on the ratchet switch SW1 again.

When the fully-latched state of the latch mechanism 10 is detected, the motor shaft of the motor 211 of the actuator 21 is reversely rotated and the pinion 212 is rotated in a counterclockwise direction, so that the sector gear 22 meshing with the pinion 212 is rotated along the arrow G2 direction. Thereby, the cancel lever 25 engaged with the sector gear 22 and the first close lever 23 engaged with the cancel lever 25 are similarly swung along the arrow G2. Thereafter, the sector gear 22 abuts on the sector switch SW2, so that such a state that the sector gear 22 has returned back to the initial position is detected and the motor 211 stops its drive.

For example, when a piece of clothing, a finger or the like is caught between the vehicle body and the slide door while the latch mechanism 10 is performing an opening action from a half-latched state to a fully-latched state, the door closing apparatus performs the following actions according to an opening operation of the inside handle or the outside handle disposed on the slide door.

Figure 9:
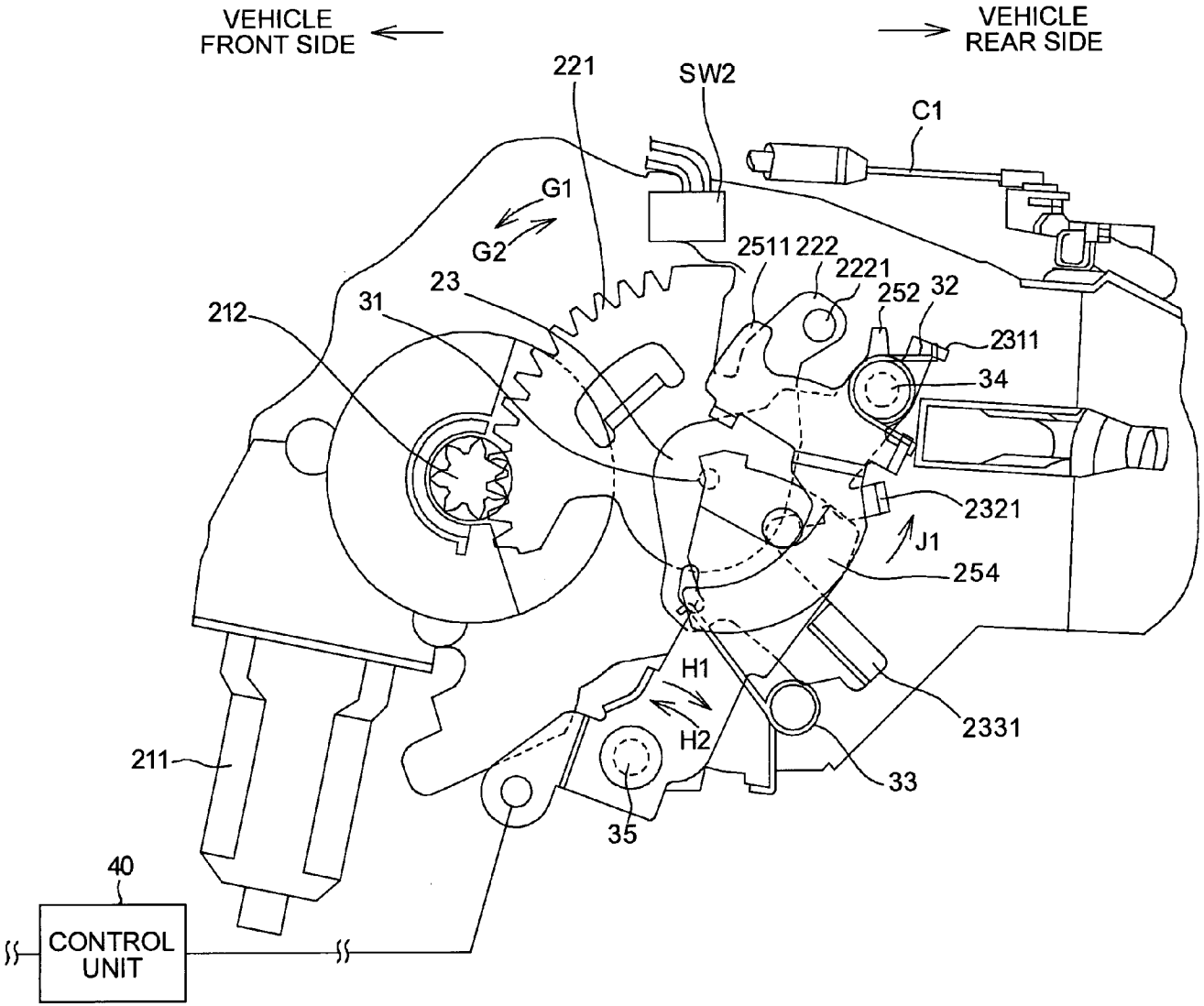
FIG. 9 is yet another schematic diagram showing more details of FIG. 1.

The fail-safe lever 26 swings about the third shaft 35 along the arrow H1 direction by the opening operation of the inside handle or the outside handle, as shown in FIG. 9. Thereby, the pin 2621 of the fail-safe lever 26 presses the bent or curved piece 254 of the cancel lever 25, the cancel lever 25 swings in an arrow J1 direction, namely, inwardly of the rotation direction of the sector gear 22, against the biasing force of the first spring 32 (performs a door opening action) and the engaging piece 2511 and the engaging projection 2221 of the sector gear 22 are disengaged from each other. At this time, the cancel lever 25 abuts on the restricting piece 2321 so that swinging thereof is restricted.

Figure 10:
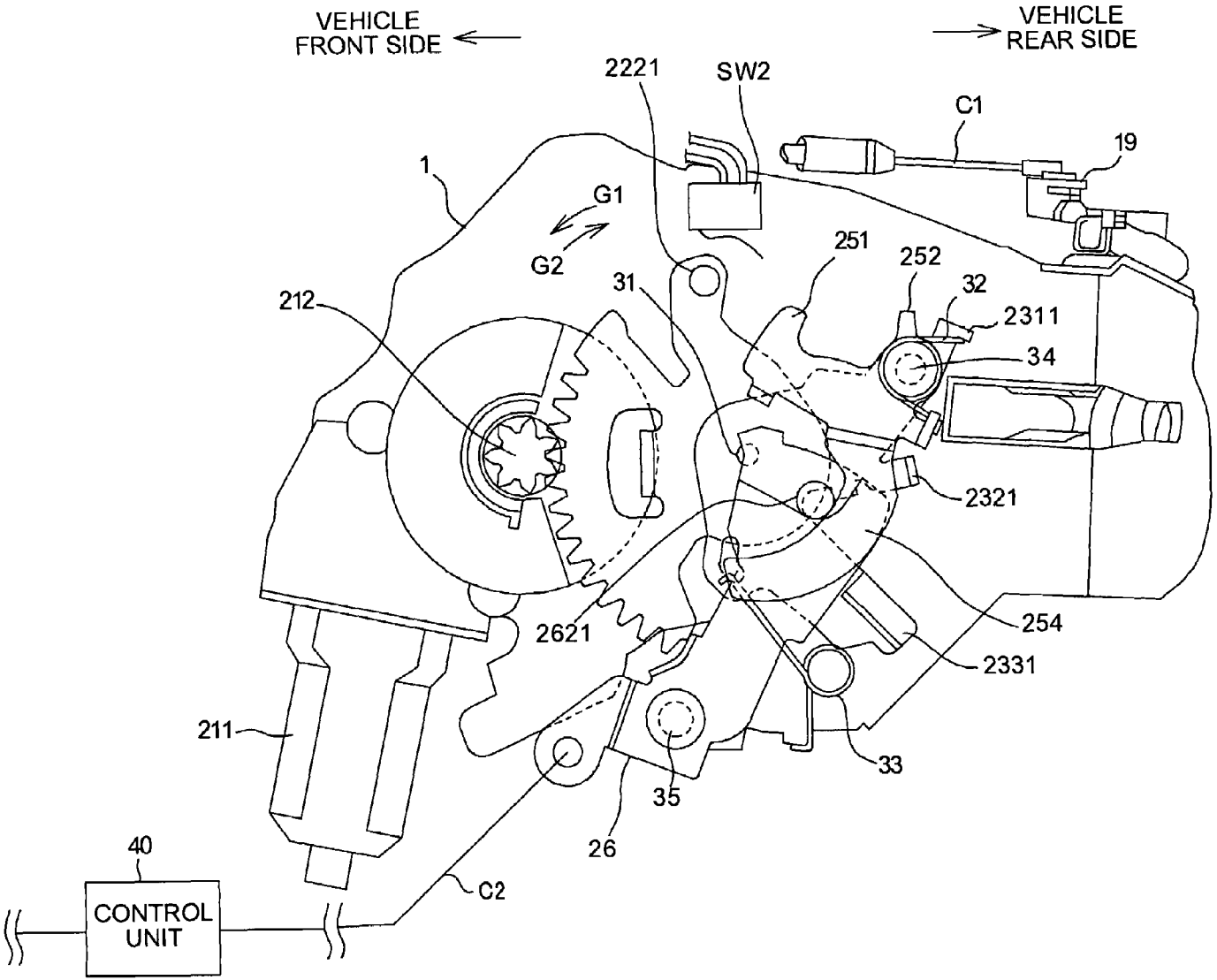
FIG. 10 is still yet another schematic diagram showing more details of FIG. 1.

Thereby, only sector gear 22 rotates along the arrow G1 direction, as shown in FIG. 10, and the first close lever 23 returns back to the initial position by the biasing force of the second spring 33. As a result, drive of the actuator 21 is not transmitted to the second close lever 24 and the like so that the drive can be disabled.

On the other hand, the open lever 19 swings approximately at the same timing as swinging of the fail-safe lever 26 according to an opening operation of the inside handle or the outside handle to abut on the abutting piece 172 of the ratchet lever 17 and causes the ratchet lever 17 to swing in the arrow E2 direction. Thereby, the retaining pawl 121 of the ratchet 12 and the pawl 112*b* are disengaged from each other, and the latch 11 swings along the arrow D2 direction by the biasing force of the latch spring 113 to reach the state shown in FIG. 2. Therefore, the latch 11 and the striker 50 are disengaged from each other, so that the slide door can be moved for opening.

According to the door closing apparatus, engagement with the sector gear 22 can be canceled by only swinging of the cancel lever 25 against the biasing force of the first spring 32 (a door opening action), so that drive of the actuator 21 can be disabled smoothly. Further, since the cancel lever 25 is disposed at the outermost position, there is no risk that mechanical interference, such as friction, occurs between the cancel lever 25 and another swinging or rotating member.

According to the door closing apparatus, since the cancel lever 25 swings inwardly of the apparatus rather than the rotational direction (the arrow G1 direction) of the sector gear 22, it is unnecessary to provide an extra space for allowing swinging of the cancel lever 25 so that the whole apparatus can be reduced in size.

According to the door closing apparatus, when an opening operation of an operation handle provided on a door is performed, engagement with the rotary body is canceled by only an opening action of the cancel lever against the biasing force of the resilient body, so that drive of the actuator can be disabled smoothly.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A door closing apparatus comprising:

a latch mechanism that is disposed on one of a vehicle body and a door to hold the door to the vehicle body in a half-closed state and in a fully-closed state;

an actuator that is driven when the door is in the half-closed state;

a rotary body that is rotated according to drive of the actuator;

a first actuation lever that performs a closing action according to rotation of the rotary body;

a second actuation lever that performs a door closing action according to the closing action of the first actuation lever to cause the latch mechanism to perform a closing action according to the door closing action, where the door closing apparatus is constituted to bring the half-closed state of the door to the fully-closed state; and a cancel lever that is swingably disposed on the first actuation lever via a first resilient body that is engaged with both the first actuation lever and the cancel lever, wherein the cancel lever is configured to engage with the rotary body by biasing force of the first resilient body in a normal state, and wherein the cancel lever is configured to disengage with the rotary body by biasing force of the first resilient body when an operation handle provided on the door is operated for opening.

2. The door closing apparatus according to claim 1, wherein the cancel lever has an engaging piece that is engaged with an engaging projection formed on the rotary body in the normal state.

3. The door closing apparatus according to claim 1, further comprising a third actuation lever that performs an opening action according to the opening operation of the operation handle, wherein the cancel lever performs the door opening action according to the opening action of the third operation lever.

4. The door closing apparatus according to claim 1, wherein the first actuation lever is swingably disposed via a second resilient body, and when the cancel lever is engaged with the rotary body, the first actuation lever causes a closing action against biasing force of the second resilient body according to rotation of the rotary body, while the first actuation lever returns back to an initial position thereof by the biasing force of the second resilient body, when the cancel lever cancels engagement with the rotary body.

5. The door closing apparatus according to claim 1, wherein the cancel lever is disposed at an outermost position from the vehicle body with respect to the rotary body and the first actuation lever.

6. The door closing apparatus according to claim 1, wherein the first actuation lever is formed with an engaging piece that retains one end of the first resilient body, and the cancel lever is formed with an engaging piece that retains an other end of the first resilient body, thereby causing the cancel lever to abut with the first actuation lever by the biasing force of the first resilient body.

* * * * *